US012151716B1

(12) United States Patent
Tu et al.

(10) Patent No.: US 12,151,716 B1
(45) Date of Patent: Nov. 26, 2024

(54) EXTERNAL ENERGY PACK LOCOMOTIVE SYSTEM

(71) Applicant: Chengdu Tulin Technology Co., Ltd., Chengdu (CN)

(72) Inventors: Guangwei Tu, Chengdu (CN); Xuanmin Wang, Chengdu (CN); Yuning Yao, Chengdu (CN); Yiting Liao, Chengdu (CN)

(73) Assignee: Future Rail Inc., Seattle, WA (US)

( * ) Notice: Subject to any disclaimer, the term of this patent is extended or adjusted under 35 U.S.C. 154(b) by 0 days.

(21) Appl. No.: 18/646,186

(22) Filed: Apr. 25, 2024

(30) Foreign Application Priority Data

Nov. 21, 2023 (CN) ..... 202311551032.6

(51) Int. Cl.
*B61C 7/04* (2006.01)

(52) U.S. Cl.
CPC ..... *B61C 7/04* (2013.01)

(58) Field of Classification Search
CPC .... B61C 7/00; B61C 7/02; B61C 7/04; B61C 9/00; B61C 11/00
See application file for complete search history.

(56) References Cited

U.S. PATENT DOCUMENTS

2008/0148993 A1 6/2008 Mack
2010/0212539 A1* 8/2010 Iden ..... B61C 5/00 105/35
2013/0113279 A1 5/2013 Hatanaka
2013/0199406 A1 8/2013 Kanda
2015/0202978 A1 7/2015 Hatanaka
2015/0251648 A1 9/2015 Okada et al.
2015/0367736 A1 12/2015 Salomonsen

FOREIGN PATENT DOCUMENTS

CN 110014854 B 6/2021

OTHER PUBLICATIONS

IP Australia, Examination Report No. 1 for Standard Patent Application AU App. No. 2024203028, 6 pages, May 31, 2024.

* cited by examiner

*Primary Examiner* — Robert J McCarry, Jr.
(74) *Attorney, Agent, or Firm* — Woodard, Emhardt, Henry, Reeves & Wagner, LLP

(57) ABSTRACT

The present invention relates to the technical field of vehicles, and particularly discloses an external energy pack locomotive system, including a diesel engine, a main generator, a rectifier, drive modules and an external energy pack, wherein the input end of the main generator is connected to the output end of the diesel engine, the input end of the rectifier is electrically connected to the output end of the main generator, the external energy pack is electrically connected to the drive modules, and each of the drive modules is electrically connected to the output end of the rectifier respectively. The participation of the diesel engine in the locomotive running process is reduced, so that the fuel consumption of the diesel engine is reduced, and the dependence on diesel is reduced; meanwhile, the external energy pack with a large energy storage capacity and a strong stability can adapt to different environmental needs and use requirements, and has the advantages of rapid acceleration, low noise and low maintenance cost, so as to greatly reduce the operation and maintenance costs of the locomotive.

8 Claims, 5 Drawing Sheets

EXTERNAL ENERGY PACK LOCOMOTIVE SYSTEM

REFERENCE TO RELATED APPLICATIONS

This application claims the benefit of Chinese Patent Application Number 202311551032.6, filed Nov. 21, 2023, which is hereby incorporated by reference.

TECHNICAL FIELD

The present invention relates to the technical field of vehicles, and in particular to an external energy pack locomotive system.

BACKGROUND

At present, the power system of DC diesel electric locomotives, such as DF4, DF7, DF8 and DF12 series locomotives, is composed of a diesel engine, a main generator, an AC/DC rectifier, traction motor control drive modules, a DC traction axle hung motor, an axle hung gearbox, a wheelset, a bogie, etc., wherein the output shaft of the diesel engine is connected to the shaft end of the main generator to drive the main generator to generate electricity, the output of alternating current is rectified by the AC/DC rectifier to direct current, the traction motor control drive modules with direct current output to each motor can also control the traction motor to generate electricity by motor commutation and magnetic field weakening control and other functions, and the generated electrical energy is consumed in the braking resistance cabinet through the resistance brake unit.

However, in the prior art, the diesel engine is used to drive the main generator to generate electricity, the exhaust and noise of the diesel engine will cause exhaust pollution and noise pollution, the diesel engine in the operation process produces harmful gases of sulfide and nitrogen oxides, which will affect the environment; meanwhile, the maintenance cost of the diesel engine is high, and the operation fuel consumption is large, which further increases the operating cost of locomotives.

SUMMARY

The objective of the present invention is to provide an external energy pack locomotive system, so as to solve the technical problems in the prior art that the exhaust and noise of the diesel engine cause exhaust pollution and noise pollution, the diesel engine in the operation process produces harmful gases of sulfide and nitrogen oxides, which will affect the environment; meanwhile, the maintenance cost of the diesel engine is high, and the operation fuel consumption is large, which further increases the operating cost of locomotives.

To achieve the aforesaid objective, the external energy pack locomotive system adopted by the present invention includes a diesel engine, a main generator, a rectifier, drive modules and an external energy pack, wherein the input end of the main generator is connected to the output end of the diesel engine, the input end of the rectifier is electrically connected to the output end of the main generator, the external energy pack is electrically connected to the drive modules, and each of the drive modules is electrically connected to the output end of the rectifier respectively.

Wherein the diesel engine, the main generator and the rectifier can be configured to provide energy separately or simultaneously with the external energy pack, the diesel engine, the main generator and the rectifier are removable in the external energy pack locomotive system, and the external energy pack is configured to provide energy separately.

Wherein a plurality of the drive modules are used.

Wherein the external energy pack locomotive system also includes an internal energy pack and an internal energy pack power control module, wherein the internal energy pack and the internal energy pack power control module are arranged in the locomotive, the internal energy pack power control module is electrically connected to input ends of the drive modules, and the internal energy pack is electrically connected to the internal energy pack power control module.

Wherein the external energy pack locomotive system also includes an energy pack power control module, wherein the output end of the energy pack power control module is electrically connected to the input ends of the drive modules, the input end of the energy pack power control module is electrically connected to the external energy pack, and the energy pack power control module is configured to control the two-way flow of energy between the external energy pack and the drive modules, wherein the first path of energy flows from the external energy pack to the drive modules, and the second path of energy flows from the drive modules to the external energy pack.

Wherein the external energy pack locomotive system also includes an energy pack power control module and a switch module, wherein the switch module is arranged in series between the drive modules and the external energy pack, the energy pack power control module is arranged in series between the external energy pack and the switch module, the energy pack power control module is electrically connected to the switch module, and the energy pack power control module is configured to control the two-way flow of energy between the external energy pack and the drive modules, wherein the first path of energy flows from the external energy pack to the drive modules, and the second path of energy flows from the drive modules to the external energy pack.

Wherein each of the drive modules includes a DC traction motor control module, a DC traction motor and a wheelset, the DC traction motor control module is electrically connected to the output end of the energy pack power control unit, the DC traction motor is electrically connected to the DC traction motor control module, and the DC traction motor is configured to drive the wheelset to rotate; and the DC traction motor control module is composed of a main contactor and circuit breaker, an energy feedback unit, a working condition controller, an excitation weakening controller, a resistance braking unit and a reversing controller.

Wherein each of the drive modules includes a DC traction motor converter, a DC traction motor control module, a DC traction motor and a wheelset, wherein the DC traction motor converter is electrically connected to the output end of the energy pack power control unit, the DC traction motor control module is electrically connected to the DC traction motor converter, the DC traction motor is electrically connected to the DC traction motor control module, and the DC traction motor is configured to drive the wheelset to rotate; and the DC traction motor control module is composed of a main contactor and circuit breaker, an energy feedback unit, a working condition controller, an excitation weakening controller, a resistance braking unit and a reversing controller.

Wherein each of the drive modules includes an AC traction motor control module, an AC traction motor and a wheelset, wherein the AC traction motor control module is electrically connected to the output end of the energy pack power control unit, the AC traction motor is electrically connected to the AC traction motor control module, and the AC traction motor is configured to drive the wheelset to rotate; and the AC traction motor control module is composed of a main contactor and circuit breaker, an energy feedback unit, a working condition controller, a resistance braking unit and an AC traction converter.

Wherein the external energy pack can be any one or a combination of ternary lithium battery, lithium iron phosphate battery, sodium-ion battery, lithium manganate battery, LIC, vanadium redox battery, hydrogen fuel cell, hydrogen internal combustion generator and methanol generator.

Wherein the external energy pack is arranged in the locomotive or in a vehicle directly or indirectly coupled to the locomotive.

The external energy pack locomotive system of the present invention has the following beneficial effects: In combination with the power system of the diesel engine and the electric motor, three modes of fuel drive, electric drive and fuel-electric hybrid drive can be adopted according to the use situation; therefore, the higher economy of the locomotive is realized, the dependence on the diesel engine is reduced, the participation of the diesel engine in the locomotive running process is reduced, and the fuel consumption and maintenance of the diesel engine are reduced; moreover, the external energy pack has low noise, strong environmental protection and no direct emission of harmful substances during the functional process, can effectively reduce air and noise pollution, and the external energy pack has a high drive efficiency, can make full use of renewable energy sources and reduce the dependence on diesel; meanwhile, the external energy pack with a strong stability can adapt to different environmental needs and use requirements, and has the advantages of rapid acceleration, low noise and low maintenance cost, so as to greatly reduce the operation and maintenance costs of the locomotive.

BRIEF DESCRIPTION OF THE DRAWINGS

To describe the technical solution in the embodiments or prior art of the present invention more clearly, the accompanying drawings to be used in the description of the embodiments or prior art will be described below briefly. It is obvious that the accompanying drawings described below are only a part of the embodiments of the present invention, and other accompanying drawings may also be obtained by those of ordinary skill in the art without making creative efforts.

DETAILED DESCRIPTION OF THE EMBODIMENTS

Figure 1:
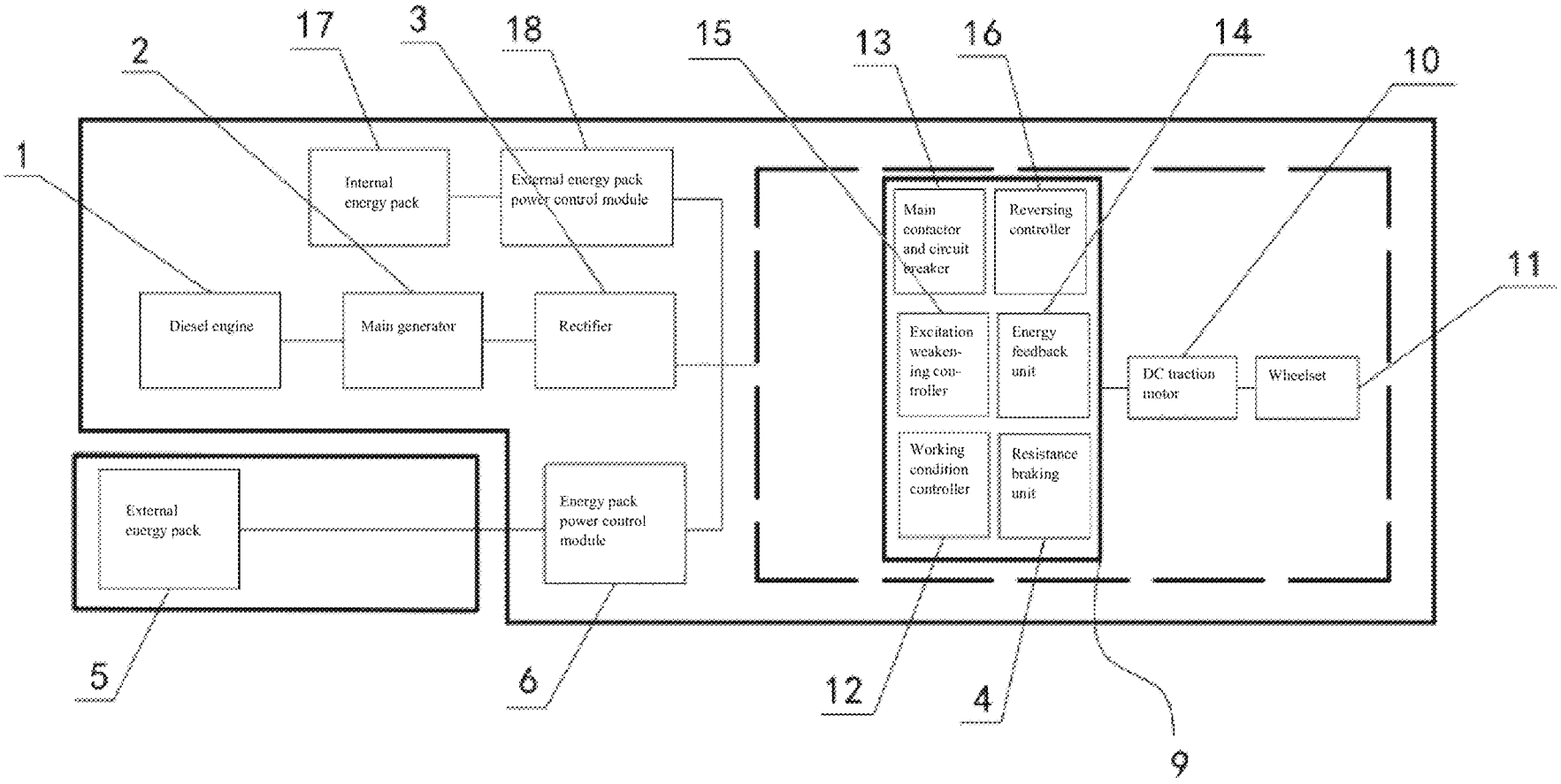
FIG. 1 is a structural view of example 1 of the present invention.
Figure 5:
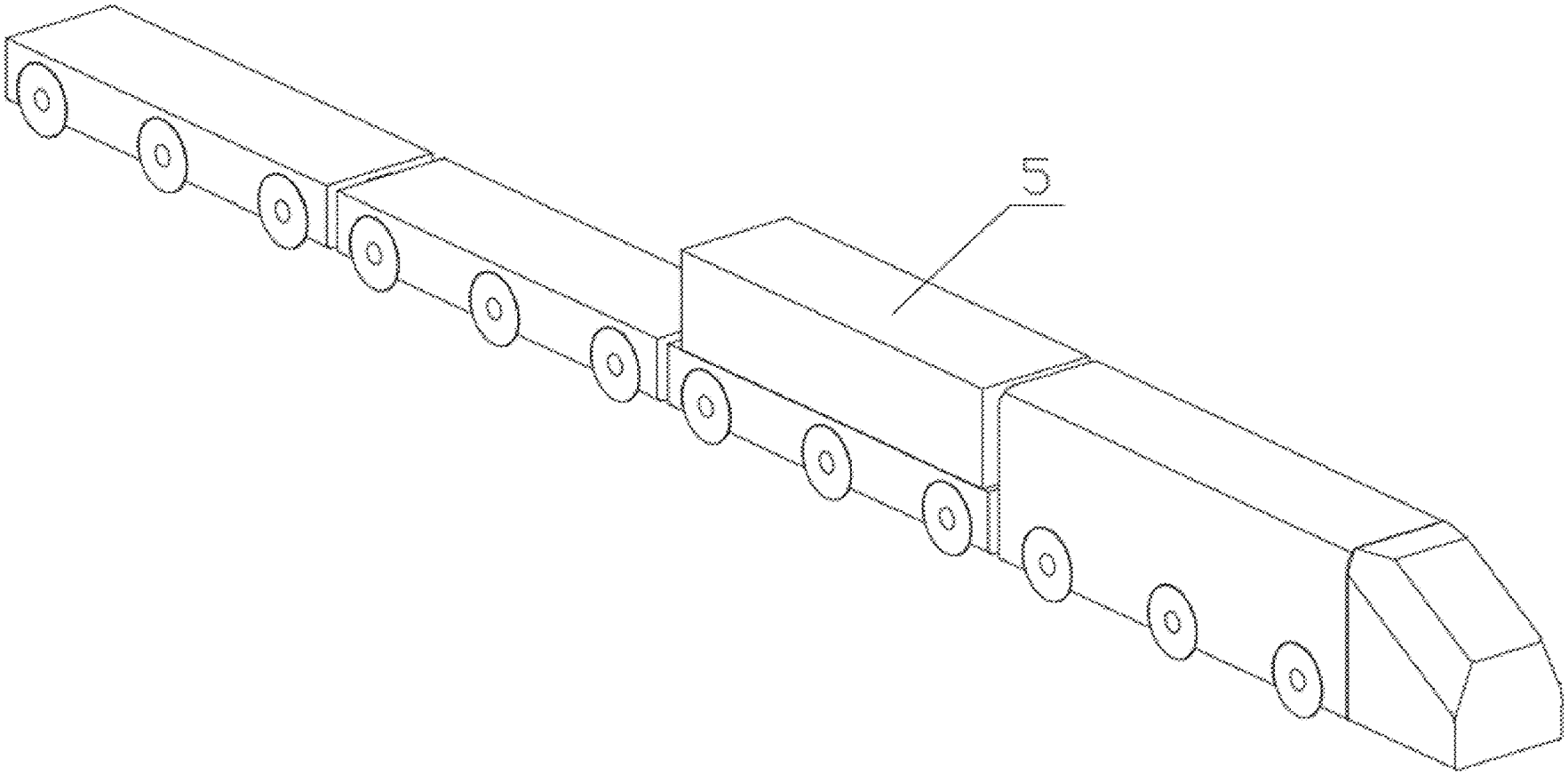
FIG. 5 is an installation structure view of an external energy pack of the present invention.

In example 1, as shown in FIGS. 1 and 5, the present invention provides an external energy pack locomotive system, including a diesel engine 1, a main generator 2, a rectifier 3, drive modules and an external energy pack 5, wherein the input end of the main generator 2 is connected to the output end of the diesel engine 1, the input end of the rectifier 3 is electrically connected to the output end of the main generator 2, the external energy pack 5 is electrically connected to the drive modules, and each of the drive modules is electrically connected to the output end of the rectifier 3 respectively.

Further, the diesel engine 1, the main generator 2 and the rectifier 3 can be configured to provide energy separately or simultaneously with the external energy pack 5, the diesel engine 1, the main generator 2 and the rectifier 3 are removable in the external energy pack locomotive system, and the external energy pack 5 is configured to provide energy separately.

Further, a plurality of the drive modules are used.

Further, the external energy pack locomotive system also includes an internal energy pack 17 and an internal energy pack power control module 18, wherein the internal energy pack 17 and the internal energy pack power control module 18 are arranged in the locomotive, the internal energy pack power control module 18 is electrically connected to input ends of the drive modules, and the internal energy pack 17 is electrically connected to the internal energy pack power control module 18.

Further, the external energy pack locomotive system also includes an energy pack power control module 6, wherein the output end of the energy pack power control module 6 is electrically connected to the input ends of the drive modules, the input end of the energy pack power control module 6 is electrically connected to the external energy pack 5, and the energy pack power control module 6 is configured to control the two-way flow of energy between the external energy pack 5 and the drive modules, wherein the first path of energy flows from the external energy pack 5 to the drive modules, and the second path of energy flows from the drive modules to the external energy pack 5.

Further, each of the drive modules includes a DC traction motor control module 9, a DC traction motor 10 and a wheelset 11, wherein the DC traction motor control module 9 is electrically connected to the output end of the energy pack power control unit, the DC traction motor 10 is electrically connected to the DC traction motor control module 9, and the DC traction motor 10 is configured to drive the wheelset 11 to rotate; and the DC traction motor control module 9 is composed of a main contactor and circuit breaker 13, an energy feedback unit 14, a working condition controller 12, an excitation weakening controller 15, a resistance braking unit 4 and a reversing controller 16.

Further, the external energy pack 5 can be any one or a combination of ternary lithium battery, lithium iron phosphate battery, sodium-ion battery, lithium manganate battery, LIC, vanadium redox battery, hydrogen fuel cell, hydrogen internal combustion generator and methanol generator.

Further, the external energy pack 5 is arranged in the locomotive or in a vehicle directly or indirectly coupled to the locomotive.

Figure 2:
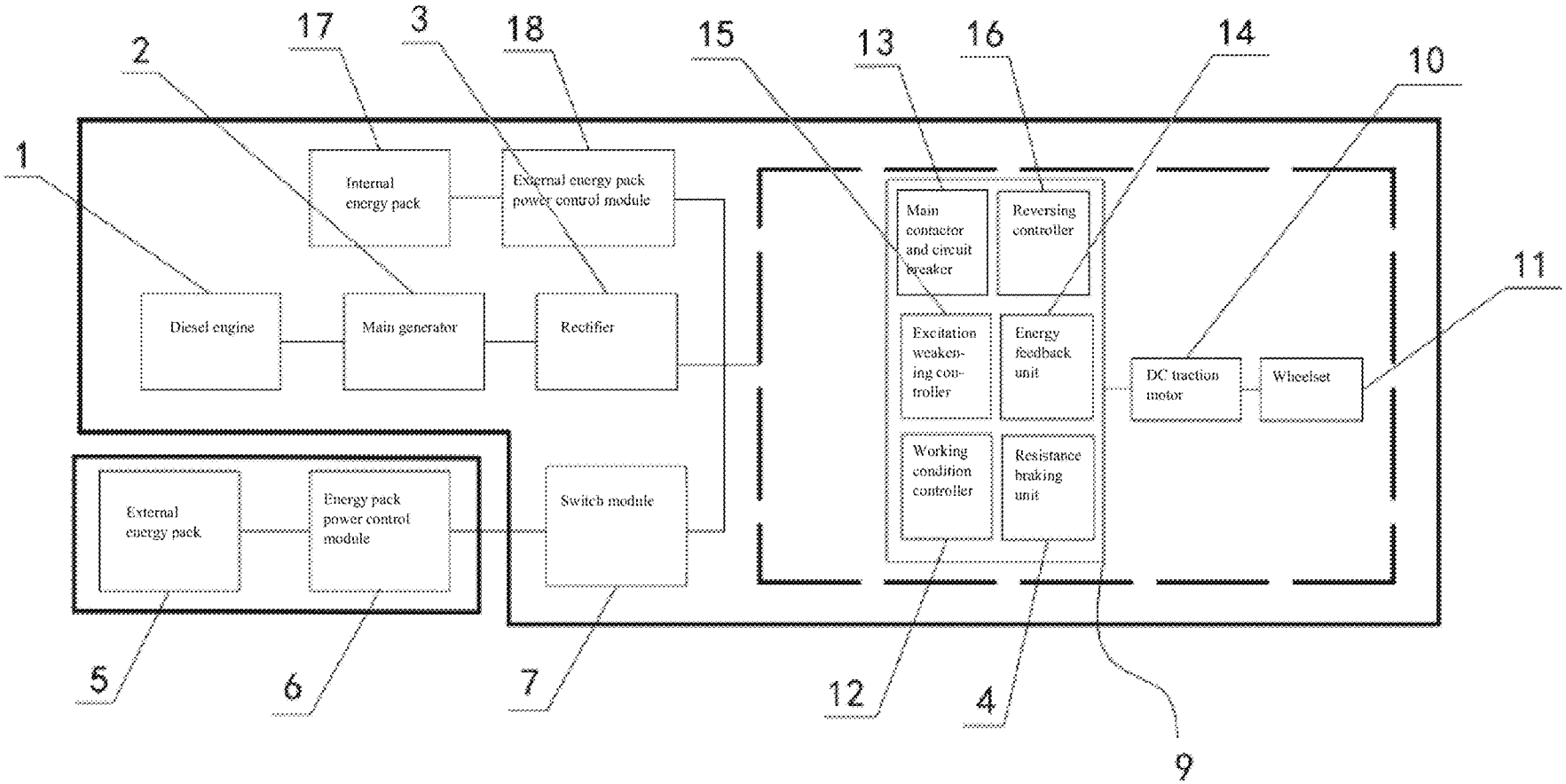
FIG. 2 is a structural view of example 2 of the present invention.

In example 2, as shown in FIGS. 2 and 5, the present invention provides an external energy pack locomotive system, including a diesel engine 1, a main generator 2, a rectifier 3, drive modules and an external energy pack 5, wherein the input end of the main generator 2 is connected to the output end of the diesel engine 1, the input end of the rectifier 3 is electrically connected to the output end of the main generator 2, the external energy pack 5 is electrically connected to the drive modules, and each of the drive modules is electrically connected to the output end of the rectifier 3 respectively.

Further, the diesel engine 1, the main generator 2 and the rectifier 3 can be configured to provide energy separately or simultaneously with the external energy pack 5, the diesel engine 1, the main generator 2 and the rectifier 3 are removable in the external energy pack locomotive system, and the external energy pack 5 is configured to provide energy separately.

Further, a plurality of the drive modules are used.

Further, the external energy pack locomotive system also includes an internal energy pack 17 and an internal energy pack power control module 18, wherein the internal energy pack 17 and the internal energy pack power control module 18 are arranged in the locomotive, the internal energy pack power control module 18 is electrically connected to input ends of the drive modules, and the internal energy pack 17 is electrically connected to the internal energy pack power control module 18.

Further, the external energy pack locomotive system also includes an energy pack power control module 6 and a switch module 7, wherein the switch module 7 is arranged in series between the drive modules and the external energy pack 5, the energy pack power control module 6 is arranged in series between the external energy pack 5 and the switch module 7, the energy pack power control module 6 is electrically connected to the switch module 7, and the energy pack power control module 6 is configured to control the two-way flow of energy between the external energy pack 5 and the drive modules, wherein the first path of energy flows from the external energy pack 5 to the drive modules, and the second path of energy flows from the drive modules to the external energy pack 5.

Further, each of the drive modules includes a DC traction motor control module 9, a DC traction motor 10 and a wheelset 11, wherein the DC traction motor control module 9 is electrically connected to the output end of the energy pack power control unit, the DC traction motor 10 is electrically connected to the DC traction motor control module 9, and the DC traction motor 10 is configured to drive the wheelset 11 to rotate; and the DC traction motor control module 9 is composed of a main contactor and circuit breaker 13, an energy feedback unit 14, a working condition controller 12, an excitation weakening controller 15, a resistance braking unit 4 and a reversing controller 16.

Further, the external energy pack 5 can be any one or a combination of ternary lithium battery, lithium iron phosphate battery, sodium-ion battery, lithium manganate battery, LIC, vanadium redox battery, hydrogen fuel cell, hydrogen internal combustion generator and methanol generator.

Further, the external energy pack 5 is arranged in the locomotive or in a vehicle directly or indirectly coupled to the locomotive.

Figure 3:
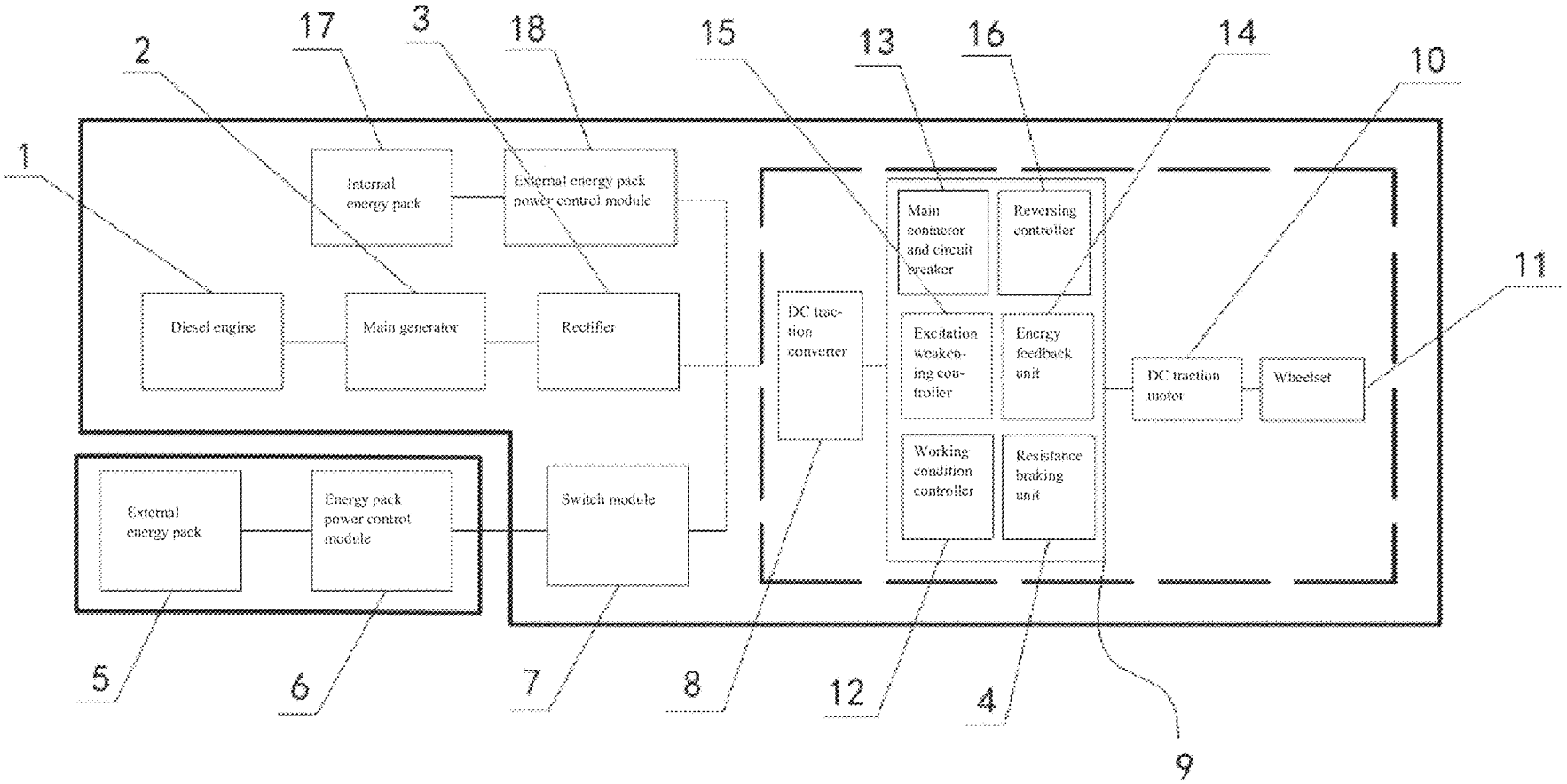
FIG. 3 is a structural view of example 3 of the present invention.

In example 3, as shown in FIGS. 3 and 5, the present invention provides an external energy pack locomotive system, including a diesel engine 1, a main generator 2, a rectifier 3, drive modules and an external energy pack 5, wherein the input end of the main generator 2 is connected to the output end of the diesel engine 1, the input end of the rectifier 3 is electrically connected to the output end of the main generator 2, the external energy pack 5 is electrically connected to the drive modules, and each of the drive modules is electrically connected to the output end of the rectifier 3 respectively.

Further, the diesel engine 1, the main generator 2 and the rectifier 3 can be configured to provide energy separately or simultaneously with the external energy pack 5, the diesel engine 1, the main generator 2 and the rectifier 3 are removable in the external energy pack locomotive system, and the external energy pack 5 is configured to provide energy separately.

Further, a plurality of the drive modules are used.

Further, the external energy pack locomotive system also includes an internal energy pack 17 and an internal energy pack power control module 18, wherein the internal energy pack 17 and the internal energy pack power control module 18 are arranged in the locomotive, the internal energy pack power control module 18 is electrically connected to input ends of the drive modules, and the internal energy pack 17 is electrically connected to the internal energy pack power control module 18.

Further, the external energy pack locomotive system also includes an energy pack power control module 6 and a switch module 7, wherein the switch module 7 is arranged in series between the drive modules and the external energy pack 5, the energy pack power control module 6 is arranged in series between the external energy pack 5 and the switch module 7, the energy pack power control module 6 is electrically connected to the switch module 7, and the energy pack power control module 6 is configured to control the two-way flow of energy between the external energy pack 5 and the drive modules, wherein the first path of energy flows from the external energy pack 5 to the drive modules, and the second path of energy flows from the drive modules to the external energy pack 5. configured to provide energy separately.

Further, a plurality of the drive modules are used.

Further, the external energy pack locomotive system also includes an internal energy pack 17 and an internal energy pack power control module 18, wherein the internal energy pack 17 and the internal energy pack power control module 18 are arranged in the locomotive, the internal energy pack power control module 18 is electrically connected to input ends of the drive modules, and the internal energy pack 17 is electrically connected to the internal energy pack power control module 18.

Further, the external energy pack locomotive system also includes an energy pack power control module 6 and a switch module 7, wherein the switch module 7 is arranged in series between the drive modules and the external energy pack 5, the energy pack power control module 6 is arranged in series between the external energy pack 5 and the switch module 7, the energy pack power control module 6 is electrically connected to the switch module 7, and the energy pack power control module 6 is configured to control the two-way flow of energy between the external energy pack 5 and the drive modules, wherein the first path of energy flows from the external energy pack 5 to the drive modules, and the second path of energy flows from the drive modules to the external energy pack 5.

Further, each of the drive modules includes an AC traction motor control module 19, an AC traction motor 21 and a wheelset 11, wherein the AC traction motor control module 19 is electrically connected to the output end of the energy pack power control unit, the AC traction motor 21 is electrically connected to the AC traction motor control module 19, and the AC traction motor 21 is configured to drive the wheelset 11 to rotate; and the AC traction motor control module 19 is composed of a main contactor and circuit breaker 13, an energy feedback unit 14, a working condition controller 12, a resistance braking unit 4 and an AC traction converter 20.

Further, the external energy pack 5 can be any one or a combination of ternary lithium battery, lithium iron phosphate battery, sodium-ion battery, lithium manganate battery, LIC, vanadium redox battery, hydrogen fuel cell, hydrogen internal combustion generator and methanol generator.

Further, the external energy pack 5 is arranged in the locomotive or in a vehicle directly or indirectly coupled to the locomotive.

Figure 4:
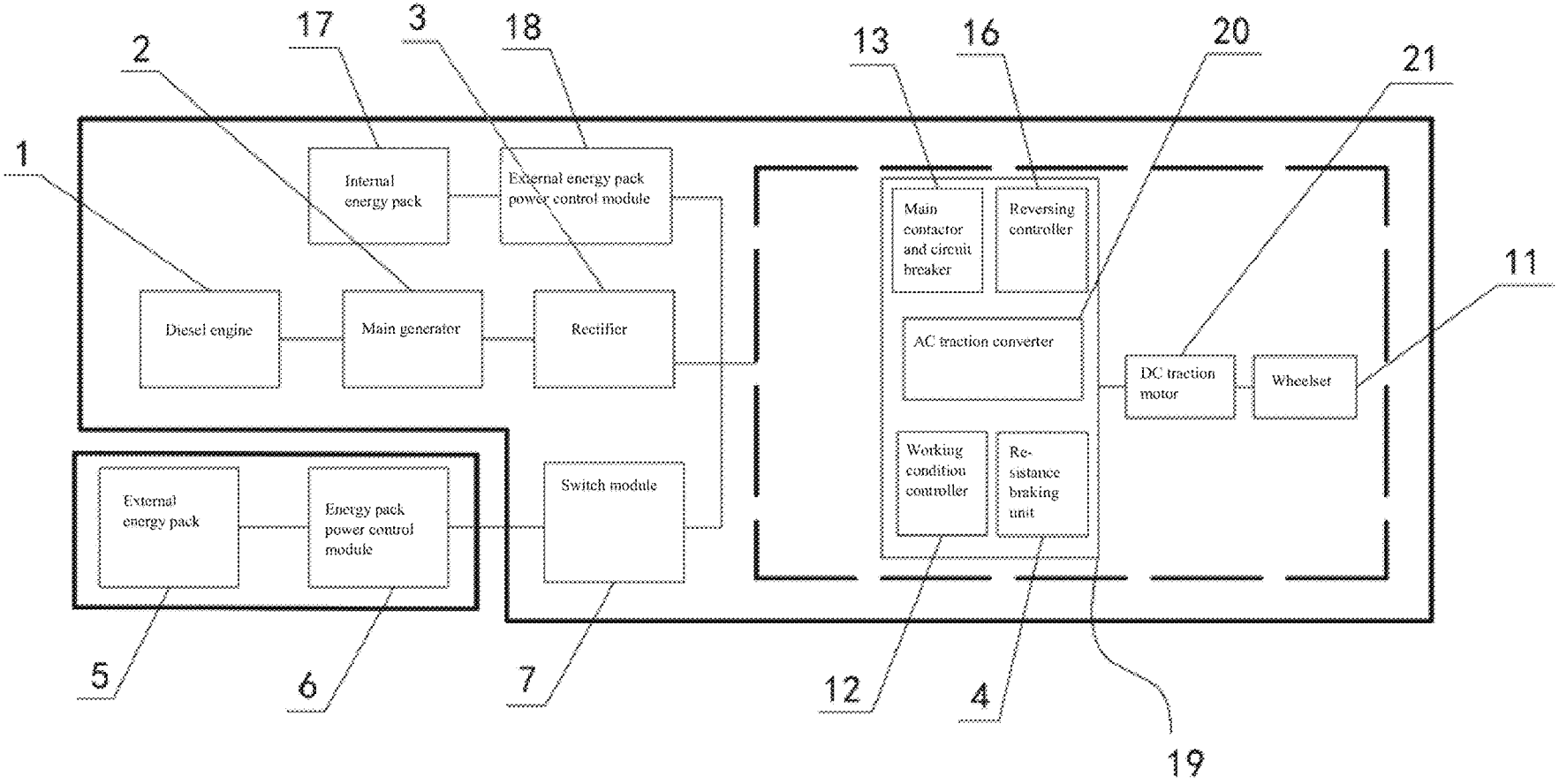
FIG. 4 is a structural view of example 4 of the present invention.

In example 4, as shown in FIGS. 4 and 5, the present invention provides an external energy pack locomotive system, including a diesel engine 1, a main generator 2, a rectifier 3, drive modules and an external energy pack 5, wherein the input end of the main generator 2 is connected to the output end of the diesel engine 1, the input end of the rectifier 3 is electrically connected to the output end of the main generator 2, the external energy pack 5 is electrically connected to the drive modules, and each of the drive modules is electrically connected to the output end of the rectifier 3 respectively.

Further, the diesel engine 1, the main generator 2 and the rectifier 3 can be configured to provide energy separately or simultaneously with the external energy pack 5, the diesel engine 1, the main generator 2 and the rectifier 3 are removable in the external energy pack locomotive system, and the external energy pack 5 is configured to provide energy separately.

Further, a plurality of the drive modules are used.

Further, the external energy pack locomotive system also includes an internal energy pack 17 and an internal energy pack power control module 18, wherein the internal energy pack 17 and the internal energy pack power control module 18 are arranged in the locomotive, the internal energy pack power control module 18 is electrically connected to input ends of the drive modules, and the internal energy pack 17 is electrically connected to the internal energy pack power control module 18.

Further, the external energy pack locomotive system also includes an energy pack power control module 6 and a switch module 7, wherein the switch module 7 is arranged in series between the drive modules and the external energy pack 5, the energy pack power control module 6 is arranged in series between the external energy pack 5 and the switch module 7, the energy pack power control module 6 is electrically connected to the switch module 7, and the energy pack power control module 6 is configured to control the two-way flow of energy between the external energy pack 5 and the drive modules, wherein the first path of energy flows from the external energy pack 5 to the drive modules, and the second path of energy flows from the drive modules to the external energy pack 5.

Further, each of the drive modules includes an AC traction motor control module 19, an AC traction motor 12 and a wheelset 1, wherein the CA traction motor control module 19 is electrically connected to the output end of the energy pack power control unit, the AC traction motor 21 is electrically connected to the AC traction motor control module 19, and the AC traction motor 21 is configured to drive the wheelset 1 to rotate; and the AC traction motor control module 19 is composed of a main contactor and circuit breaker 13, an energy feedback unit 14, a working condition controller 12, a resistance braking unit 4 and an AC traction converter 20.

Further, the external energy pack 5 can be any one or a combination of ternary lithium battery, lithium iron phosphate battery, sodium-ion battery, lithium manganate battery, LIC, vanadium redox battery, hydrogen fuel cell, hydrogen internal combustion generator and methanol generator.

Further, the external energy pack 5 is arranged in the locomotive or in a vehicle directly or indirectly coupled to the locomotive.

In the present invention, the diesel engine 1 drives the main generator 2 to generate electricity, the generated alternating current is rectified through the rectifier 3, the rectified direct current is inputted to the drive modules to drive the DC traction motor 10 to rotate, then the DC traction motor 10 drives the wheelset 11, and the external energy pack 5 supplies the current to the drive modules through the energy pack power control module 6.

In the present invention, in combination with the power system of the diesel engine 1 and the electric motor, three modes of fuel drive, electric drive and fuel-electric hybrid drive can be adopted according to the use situation; therefore, the higher economy of the locomotive is realized, the dependence on the diesel engine 1 is reduced, the participation of the diesel engine 1 in the locomotive running process is reduced, and the fuel consumption and maintenance of the diesel engine 1 are reduced; moreover, the external energy pack 5 has low noise, strong environmental protection and no direct emission of harmful substances during the functional process, can effectively reduce air and noise pollution, and plays an effective role in reducing greenhouse gas emissions, improving air quality and protecting the environment, and the external energy pack 5 has a high drive efficiency, can make full use of renewable energy sources and reduce the dependence on diesel; meanwhile, the external energy pack 5 with a strong stability can adapt to different environmental needs and use requirements, and the electrically-driven mechanical components are less and the maintenance cost is low, so as to effectively reduce the operating cost; and the electric drive has the advantages of rapid acceleration, low noise and low maintenance cost, so as to greatly reduce the operation and maintenance costs of the locomotive, and effectively improve the efficiency of locomotive operation.

The above-mentioned disclosure is only the preferred embodiments of the present invention, of course, it cannot be used to limit the scope of claims of the present invention. All or part of the process for the realization of the above-mentioned embodiments can be understood by those of ordinary skill in the art, and equivalent changes made in accordance with the claims of the present invention should still fall within the scope covered by the present invention.

The invention claimed is:

1. An external energy pack locomotive system, comprising a diesel engine, a main generator, a rectifier, a plurality of drive modules, an external energy pack, an internal energy pack, and an internal energy pack power control module, wherein the input end of the main generator is connected to the output end of the diesel engine, the input end of the rectifier is electrically connected to the output end of the main generator, the external energy pack is electrically connected to the drive modules, and each of the drive modules is electrically connected to the output end of the rectifier respectively, wherein the diesel engine, the main generator and the rectifier are configured to provide energy along with the external energy pack, the diesel engine, the main generator and the rectifier are removable in the external energy pack locomotive system, and wherein the internal energy pack and the internal energy pack power control module are arranged in a locomotive, the internal energy pack power control module is electrically connected to input ends of the drive modules, and the internal energy pack is electrically connected to the internal energy pack power control module.

2. The external energy pack locomotive system of claim 1, wherein the external energy pack locomotive system also comprises an energy pack power control module, wherein the output end of the energy pack power control module is electrically connected to the input ends of the drive modules, the input end of the energy pack power control module is electrically connected to the external energy pack, and the energy pack power control module is configured to control the two-way flow of energy between the external energy pack and the drive modules, wherein the first path of energy flows from the external energy pack to the drive modules, and the second path of energy flows from the drive modules to the external energy pack.

3. The external energy pack locomotive system of claim 2, wherein each of the drive modules comprises a DC traction motor control module, a DC traction motor and a wheelset, wherein the DC traction motor control module is electrically connected to the output end of the energy pack power control unit, the DC traction motor is electrically connected to the DC traction motor control module, and the DC traction motor is configured to drive the wheelset to rotate; and the DC traction motor control module is composed of a main contactor and circuit breaker, an energy feedback unit, a working condition controller, an excitation weakening controller, a resistance braking unit and a reversing controller.

4. The external energy pack locomotive system of claim 2, wherein each of the drive modules comprises a DC traction motor converter, a DC traction motor control module, a DC traction motor and a wheelset, wherein the DC traction motor converter is electrically connected to the output end of the energy pack power control unit, the DC traction motor control module is electrically connected to the DC traction motor converter, the DC traction motor is electrically connected the DC traction motor control module, and the DC traction motor is configured to drive the wheelset to rotate; and the DC traction motor control module is composed of a main contactor and circuit breaker, an energy feedback unit, a working condition controller, an excitation weakening controller, a resistance braking unit and a reversing controller.

5. The external energy pack locomotive system of claim 2, wherein each of the drive modules comprises an AC traction motor control module, an AC traction motor and a wheelset, wherein the AC traction motor control module is electrically connected to the output end of the energy pack power control unit, the AC traction motor is electrically connected to the AC traction motor control module, and the AC traction motor is configured to drive the wheelset to rotate; and the AC traction motor control module is composed of a main contactor and circuit breaker, an energy feedback unit, a working condition controller, a resistance braking unit and an AC traction converter.

6. The external energy pack locomotive system of claim 1, wherein the external energy pack locomotive system also comprises an energy pack power control module and a switch module, wherein the switch module is arranged in series between the drive modules and the external energy pack, the energy pack power control module is arranged in series between the external energy pack and the switch module, the energy pack power control module is electrically connected to the switch module, and the energy pack power control module is configured to control the two-way flow of energy between the external energy pack and the drive modules, wherein the first path of energy flows from the external energy pack to the drive modules, and the second path of energy flows from the drive modules to the external energy pack.

7. The external energy pack locomotive system of claim 1, wherein the external energy pack can be any one or a combination of ternary lithium battery, lithium iron phosphate battery, sodium-ion battery, lithium manganate battery, LIC, vanadium redox battery, hydrogen fuel cell, hydrogen internal combustion generator and methanol generator.

8. The external energy pack locomotive system of claim 7, wherein the external energy pack is arranged in the locomotive or in a vehicle directly or indirectly coupled to the locomotive.

* * * * *